United States Patent [19]

Natsumeda et al.

[11] Patent Number: 4,677,904

[45] Date of Patent: Jul. 7, 1987

[54] FLUID FLOW CONTROL ASSEMBLY

[75] Inventors: Takeshi Natsumeda; Motoyuki Nawa, both of Nara; Norio Sugawara, Shiki, all of Japan

[73] Assignee: Matsushita Electric Industrial Co., Ltd., Osaka, Japan

[21] Appl. No.: 864,464

[22] Filed: May 19, 1986

[30] Foreign Application Priority Data

May 20, 1985 [JP] Japan ..... 60-107325
Jun. 28, 1985 [JP] Japan ..... 60-142882

[51] Int. Cl.[4] ..... F24F 7/00

[52] U.S. Cl. ..... 98/38.1; 98/38.6; 98/38.8; 98/40.24; 98/40.26

[58] Field of Search ..... 98/38.1, 39, 38.4–38.9, 98/40.12, 40.24, 40.26, 41.1, 41.3, 2.05

[56] References Cited

U.S. PATENT DOCUMENTS

| | | | |
|---|---|---|---|
| 2,267,425 | 12/1941 | Rowe et al. | 98/38.5 |
| 3,179,125 | 4/1965 | O'Day et al. | 98/38.6 |
| 3,257,931 | 6/1966 | Lupton | 98/40.26 |
| 3,468,239 | 9/1969 | DeHart et al. | 98/40.24 |
| 3,613,548 | 10/1971 | Motts | 98/38.6 |
| 3,949,656 | 4/1976 | Lohmann | 98/40.24 |
| 3,973,590 | 8/1976 | Logsdon | 98/38.8 |
| 4,113,176 | 9/1978 | Caknis | 98/38.4 |
| 4,178,840 | 12/1979 | Caknis | 98/38.7 |
| 4,607,565 | 8/1986 | Sugawara et al. | 98/40.24 |

*Primary Examiner*—Henry C. Yuen
*Attorney, Agent, or Firm*—Wenderoth, Lind & Ponack

[57] ABSTRACT

A fluid flow control assembly which comprises an inlet defining structure through which a fluid medium flows in one direction, a partitioning member for dividing the fluid flow into first and second fluid streams, an outlet defining structure positioned downstream of the inlet defining structure and including a pair of outwardly diverging guide walls, first and second deflector vanes disposed in respective paths of travel of the first and second fluid streams for controlling the respective directions of flow of the first and second fluid streams, and a passage defining structure for providing a passage for guiding a third fluid stream in a direction generally at right angles to the direction of flow of any one of the first and second fluid streams. The partitioning member may be a partition wall, a cylindrical column or a cylindrical burner.

14 Claims, 15 Drawing Figures

FLUID FLOW CONTROL ASSEMBLY

BACKGROUND OF THE INVENTION

The present invention generally relates to a fluid flow control assembly and, more particularly, to the fluid flow control assembly for use as a fluid outlet grille structure of a fan-forced space heater such as, for example, a fan-forced oil heater, a fan-forced gas heater or a fan-forced electric heater, or an air-conditioner.

A device for controlling respective flows of the two incoming fluid streams is disclosed in, for example, the Japanese Laid-open Patent Publication No. 57-166441 published Oct. 13, 1982, and reproduced in FIG. 1 of the accompanying drawings in top sectional representation. As shown in FIG. 1, the prior art device comprises a generally rectangular, open-sided frame structure having two divided fluid passages each communicated at one and with a source of incoming fluid and at the opposite end delimited by a pair of curved guide walls arranged so as to outwardly diverge away from each other. The frame structure has a pair of constricted nozzle openings defined in the respective fluid passages upstream of and behind the respective pairs of the curved guide walls with respect to the direction of flow of fluid streams through the respective nozzle openings.

A pair of constricting plates arranged in the frame structure for each nozzle opening and defining the respective nozzle opening therebetween define spaced apart control windows R1 and R2, or L1 and L2, in cooperation with upstream ends of the curved guide walls, which windows are in communication with respective chambers defined exteriorly of and on respective sides of the associated fluid passage. One of the paired chambers for each fluid passage is provided with an electromagnetic valve SV1 or SV2 for controlling the flow of fluid into the adjacent fluid passage through the associated control window R1 or L2, so that the fluid streams ready to emerge outwardly from the respective fluid passages can be deflected rightwards or leftwards, as viewed in FIG. 1, by controlling the flow of fluid into the fluid passages through the associated control windows R1 and L2.

With the prior art device of the above described construction, it has been found that the flow of each fluid stream is deflected in the form of a beam, i.e., having a reduced flow width, as shown by P and Q and, accordingly, the draft of fluid as a whole tends to have such a strong directivity that only a limited region of space can receive the draft of fluid.

SUMMARY OF THE INVENTION

The present invention has been deviced with a view to substantially eliminating the above described disadvantages inherent in the prior art device and has for its essential object to provide an improvement fluid flow control assembly effective to render the draft of fluid to cover a relatively large area of space while the fluid draft has an increased flow width.

This and other objects of the present invention is, according to the present invention, accomplished by introducing a third stream of fluid in between the first and second streams of fluid in a direction at right angles thereto, so that the draft of fluid as a whole emerging outwardly from the assembly can have an increased flow width.

BRIEF DESCRIPTION OF THE DRAWINGS

This and other objects and features of the present invention will become clear from the following description taken in conjunction with preferred embodiments thereof with reference to the accompanying drawings, in which.

DETAILED DESCRIPTION OF THE EMBODIMENTS

Figure 1:
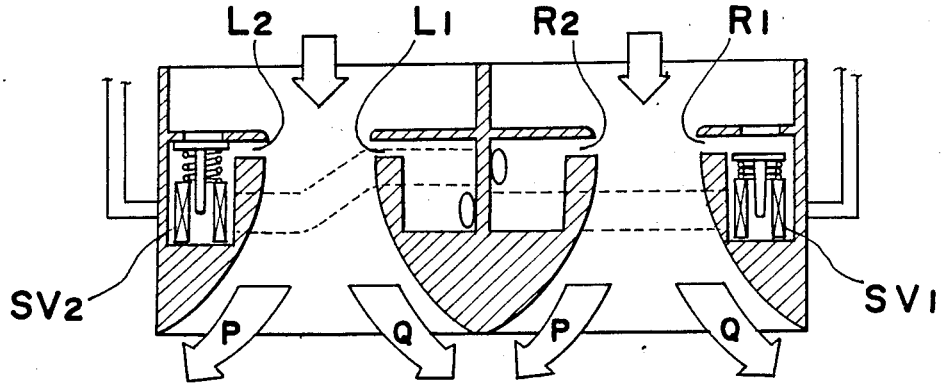
Fig. 1 Prior Art
FIG. 1 is a top sectional view of the prior art fluid flow control assembly.
Figure 2:
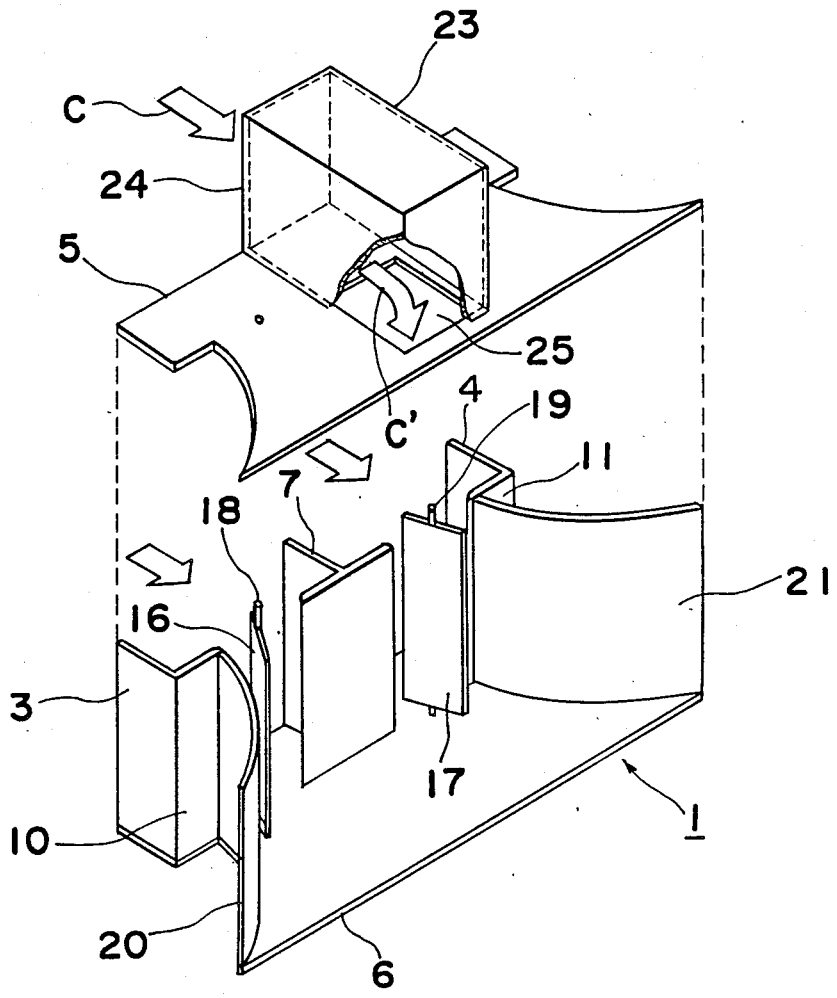
FIG. 2 is an exploded perspective view of a fluid flow control assembly according to a first embodiment of the present invention.
Figure 3:
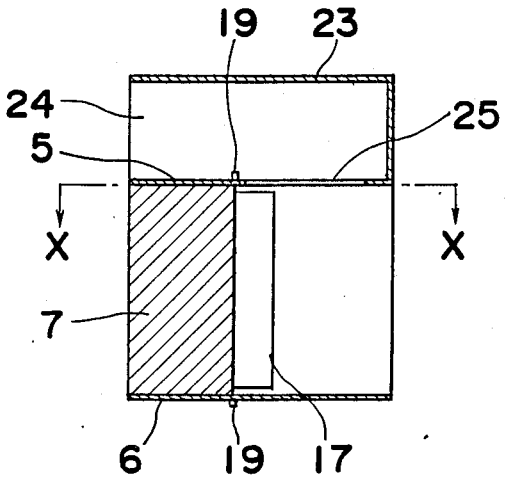
FIG. 3 is a side sectional view of the assembly in FIG. 2.
Figure 4:
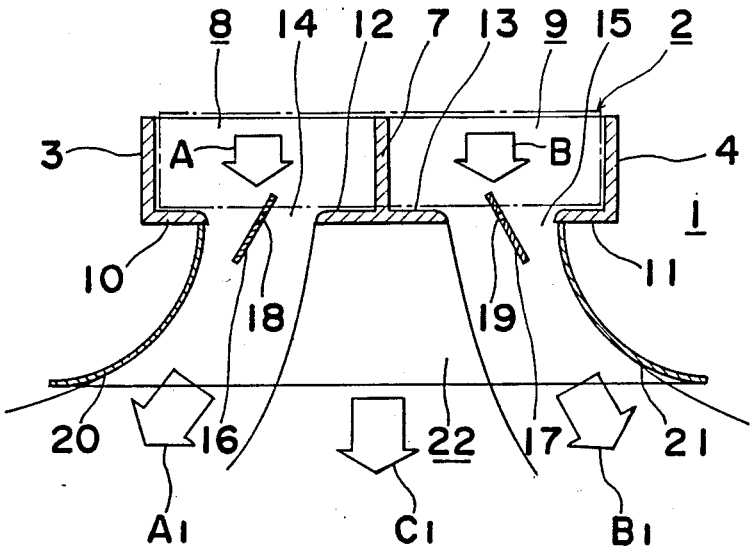
FIGS. 4 to 7 are cross-sectional views, taken along the line X—X in FIG. 3, of the assembly with deflector vanes held in different operative portions, respectively.

Referring to FIGS. 2 to 4, a fluid flow control assembly generally identified by 1 has a fluid inlet region 2 delimited by a pair of opposite side walls 3 and 4, and top and bottom walls 5 and 6 all connected together so as to represent a generally rectangular frame structure having front and rear open ends, the terms "front" and "rear" being used in relation to the direction of flow of a fluid medium to be deflected. The fluid inlet region 2 is divided into left-hand and right-hand inlet chambers 8 and 9 by a partitioning member which, in the embodiment shown in FIGS. 2 to 7 as well as that shown in FIG. 8, comprises an intermediate partition wall 7 extending between the top and bottom walls 5 and 6 in parallel relationship with any one of the side walls 3 and 4.

The frame structure comprised of the walls 3 to 6 and defining the inlet region 2 therein has generally rectangular nozzle openings 14 and 15 defined at the front open end in communication respectively with the inlet chambers 8 and 9, with the longitudinal sense of each of the nozzle openings 14 and 15 lying perpendicular to any one of the top and bottom walls 5 and 6 and parallel to any one of the side walls 3 and 4. The left-hand nozzle opening 14 is defined by spaced constricting plates, or nozzle forming plates, 10 and 12, the constricting plate 10 being secured to, or otherwise integrally formed with, the side wall 3 so as to lie at right angles thereto, whereas the constricting plate 12 is secured to or otherwise integrally formed with the partition wall 7 so as to lie at right angles thereto. Similarly, the right-hand nozzle opening 15 is defined by spaced constricting plates, or nozzle forming plates, 11 and 13, which are secured to, or otherwise integrally formed with the respective walls 4 and 7 so as to lie at right angles thereto. It is to be noted that a single plate having a substantial width may be employed instead of the use of the separate constricting plates 12 and 13 for the nozzle openings 14 and 15, or alternatively, a single plate member molded so as to have a generally T-shaped cross-section may be employed instead of the use of the partition wall 7 employed with the constricting plates 12 and 13.

The frame structure also has a guide hood generally flared outwardly from the front open end thereof. This hood is comprised of a pair of spaced curved guide walls 20 and 21 each secured to or otherwise integrally formed with one of the opposite side edges of the respective constricting plate 10 or 11 remote from the associated side wall 3 or 4, said walls 20 and 21 protruding outwardly of the frame structure so as to diverge from each other. It is to be noted that each of the top and bottom walls 5 and 6 employed in the embodiment now under discussion is so shaped and so sized as to cover not only the top or bottom of the frame structure, but also the top or bottom space delimited by the spaced guide walls 20 and 21. Therefore, the hood is generally in the form of a bell flare flattened so as to have a rectangular cross-section. A rear end of the hood is in communication with the fluid inlet region 2, i.e., the inlet chambers 8 and 9 with the partitioning member positioned intermediately of the width thereof as measured in a direction between the curved walls 20 and 21, and a front end of the hood defines a fluid outlet 22.

The fluid flow control assembly comprises, in addition to the frame structure and the guide hood, a generally rectangular deflector vane 16 or 17 for each nozzle opening 14 or 15. The deflector vane 16 or 17 for each nozzle opening 14 or 15 has stud shafts 18 or 19 protruding outwardly from the opposite ends of the respective vane 16 or 17 and journalled to the top and bottom walls 5 and 6, respectively, so that it can pivot between first and second end positions about a hinge axis defined by the stud shafts 18 or 19. Each of these deflector vanes 16 and 17 serves, and is operable, to control direction of flow of a stream of fluid, emerging through the associated nozzle opening 14 or 15 into the guide hood, in a direction dependent on the position thereof as will be described later with particular reference to FIGS. 4 to 7.

In the construction so far described, a fluid medium supplied from a source thereof (not shown) towards the inlet region 2 flows in part into the left-hand inlet chamber 8 and in part into the right-hand inlet chamber 9 as shown by the arrows A and B in FIG. 4, respectively, and subsequently emerges outwardly through the nozzle openings 14 and 15 into the guide hood in the form of divided streams of fluid as indicated by the arrows A1 and B1, respectively. Respective directions of flow of the fluid streams A1 and B1 ready to emerge outwardly from the hood are determined by the positions of the deflector vanes 16 and 17 as will be discussed later.

As best shown in FIGS. 2 and 3, a portion of the top wall 5 positioned above the adjoining constricting plates 12 and 13 is blanked to provide a downthrow opening 25 opening into the hood and towards the bottom wall 6 frontwardly of the adjoining constricting plates 12 and 13. A passage defining covering 23 is mounted on the top wall 5 so as to overlay the downthrow opening 25 and open at one end 24 immediately above the rear end of the frame structure for the introduction of the fluid medium thereinto in a direction, shown by the arrow C in FIG. 2, separately from that entering the inlet region 2. Thus, a steam of fluid flowing through the passage defining covering 23 can be, after having impinged upon the closed end of the covering 23 opposite to the open end 24, deflected downwards so as to flow through the downthrow opening 25 in a manner as indicated by the arrow C' and towards the bottom wall 6 generally along the adjoining constricting plates 12 and 13, and can again be deflected by the bottom wall 6 so as to flow within the hood towards the fluid outlet 22. It is to be noted that the fluid stream flowing into the hood through the downthrow opening 25 travels generally perpendicular to the flow of any one of the fluid streams emerging through the respective nozzle openings 14 and 15 into the hood.

The function of the fluid flow control assembly of the above described construction will now be described with particular reference to FIGS. 4 to 7.

FIG. 4 illustrates the deflector vanes 15 and 16 held in the first position and the second position, respectively. In other words, the deflector vanes 16 and 17 shown in FIG. 4 are so positioned as to diverge outwardly with respect to each other as viewed in the direction of flow of the fluid medium as a whole. In the condition shown in FIG. 4, the flow of fluid entering the inlet region 2 is divided by the partition wall 7 into the streams of fluid shown respectively by the arrows A and B, which streams A and B are deflected by the deflector vanes 16 and 17 so as to attached to and subsequently flow along the opposite guide walls 20 and 21, respectively, as shown by the outwardly diverging arrows A1 and A2. On the other hand, the stream of fluid entering the covering 23 as shown by the arrow C is deflected by the closed end of the covering 23 so as to flow in the hood through the downthrow opening 25 as shown by the arrow C'. At this time, the fluid stream C' diverges to join the fluid streams A1 and B1 and is, after having impinged upon the bottom wall 6 frontwardly of the adjoining constricting plates 12 and 13 and therefore spread in a directio away from the adjoining constricting plates 12 and 13, forced to flow as shown by the arrow C1 while filling up a gap between the fluid streams A1 and B1. Thus, in the condition shown in FIG. 4, the fluid streams A1 and B1 are joined together through the fluid stream C1 and, therefore, a draft of fluid emerging outwardly from the outlet 22 as a whole spreads a maximum available angle, covering a relatively large space.

Figure 5:
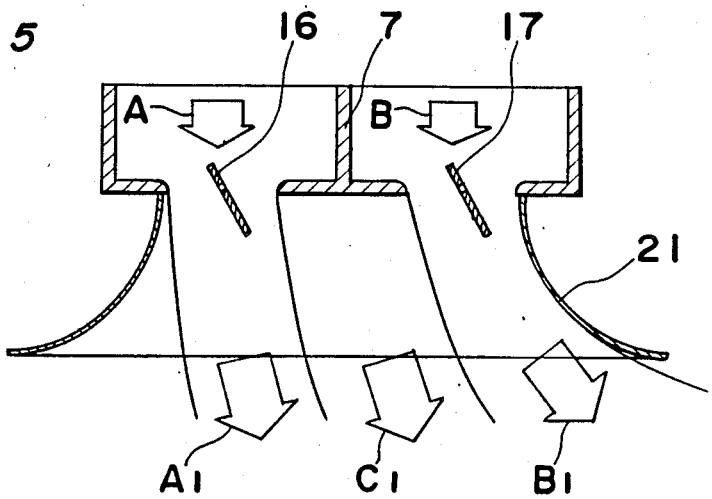

FIG. 5 illustrates both of the deflector vanes 16 and 17 held in the second position. In this condition, the fluid stream B emerging outwardly through the nozzle opening 15 attaches to the guide wall 21 and then flows in a direction rightwards, as viewed in FIG. 5, along the guide wall 21 in the form of the fluid stream B1, whereas the fluid stream A1 is deflected by the deflector vane 16 so as to flow rightwards as it emerges outwardly through the nozzle opening 14 past the deflector vane 16, forming the fluid stream A1 tending to flow generally in parallel relatioship with the fluid stream B1. However, the fluid stream C1 mingles with the fluid stream B1 flowing along the guide wall 21 on the one hand and acts to bring the fluid stream A1, then tending to flow generally in parallel relatioship with the fluid stream B1, straight on the other hand, and therefore, the draft of fluid emerging outwardly from the outlet 22 as a whole is biased rightwards and has, when viewed from above as shown in FIG. 5, its right-hand limit curved to follow the curvature of the guide wall 21 and its left-hand limit extending generally straight, covering a right-hand half of the space.

It is to be noted that a left-hand half of the space can be covered when both of the deflector vanes 16 and 17 are pivoted to the first position to establish a condition right opposite to that shown in FIG. 5.

Figure 6:
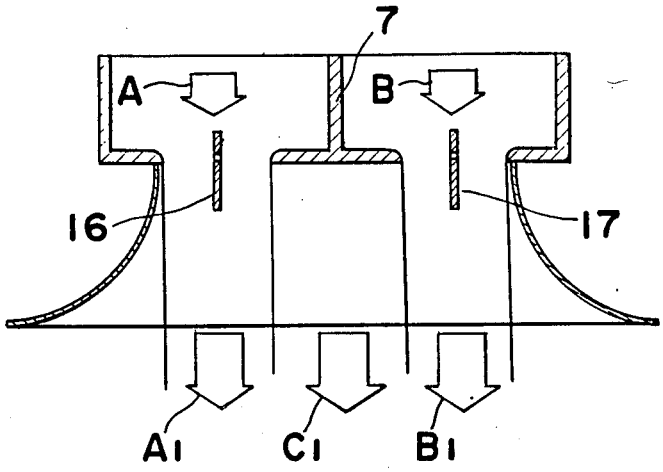

FIG. 6 illustrates both of the deflector vanes 16 and 17 held in a position intermediate between the first and second positions. In this condition, the fluid streams A1 and B1 flow straight without being deflected by the associated deflector vanes 16 and 17 and, therefore, the fluid stream C1 is also guided to flow straight between the fluid streams A1 and B1. As a result, the draft of fluid emerging outwardly from the outlet 22 as a whole flows straightforwards, covering a substantially intermediate portion of the space.

Figure 7:
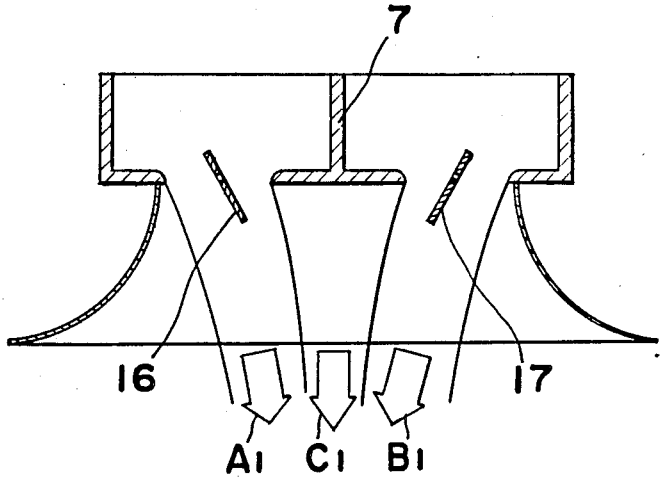

FIG. 7 illustrates the deflector vanes 16 and 17 held in the second position and the first position, respectively, in which condition the fluid streams A1 and B1 are directed so as to converge with each other whereas the flow of the fluid stream C1 is restricted by the fluid streams A1 and B1. Therefore, in the condition, the draft of fluid emerging outwardly from the outlet 22 as a whole is centered on a portion of the space spaced a distance from, and intermediate of the width of, the fluid flow deflecting assembly.

In the embodiment shown in and described with reference to FIGS. 2 to 7, the partitioning member comprised of the partitioning wall 7 and the constricting plates 12 and 13 has been described as extending between the top and bottom walls 5 and 7. However, the partitioning member rigidly mounted on the bottom wall 6 may terminate spaced a distance inwardly from the top wall 5, such as shown in FIGS. 8 and 9, leaving a space between the top wall 5 and the top of the partitioning member for the passage of the fluid stream C.

Figure 8:
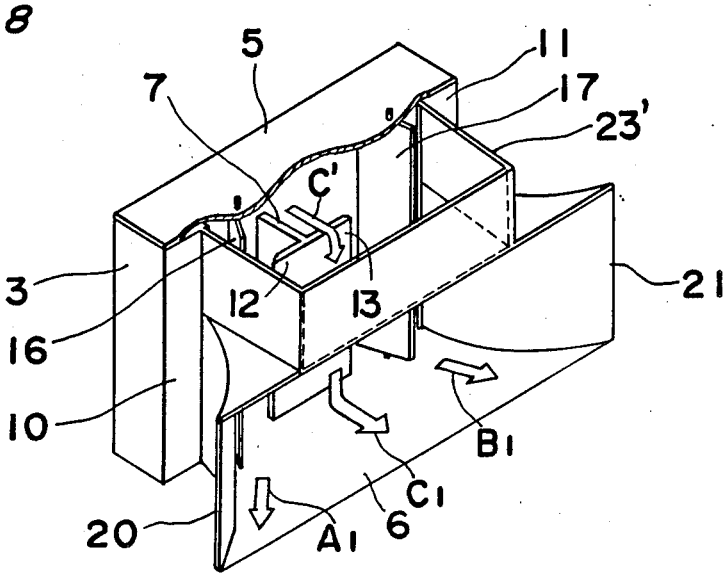
FIG. 8 and FIG. 9 are perspective views, with a portion cut away, of the fluid flow control assembly according to second and third embodiments of the present invention; respectively.

Referring first to FIG. 8 in order for the fluid stream C to be deflected so as to flow downwards generally along the adjoining partition plates 12 and 13 as shown by C', the frame structure has a height greater than that of each of the guid walls 20 and 21 so that a space for the flow of the fluid stream C can be defined between the top of the partitioning member and the top wall 5. The top wall 5 employed in the embodiment shown in FIG. 8 is of a generally T-shaped configuration, and a space between the top wall 5 and the top of the hood is confined by a generally U-sectioned covering 23' opening towards the space between the top wall 5 and the top of the partitioning member and also towards the interior of the hood.

The flow control assembly according to the embodiment shown in FIG. 8 functions in a manner substantially similar to that according to the foregoing embodiment.

Figure 9:
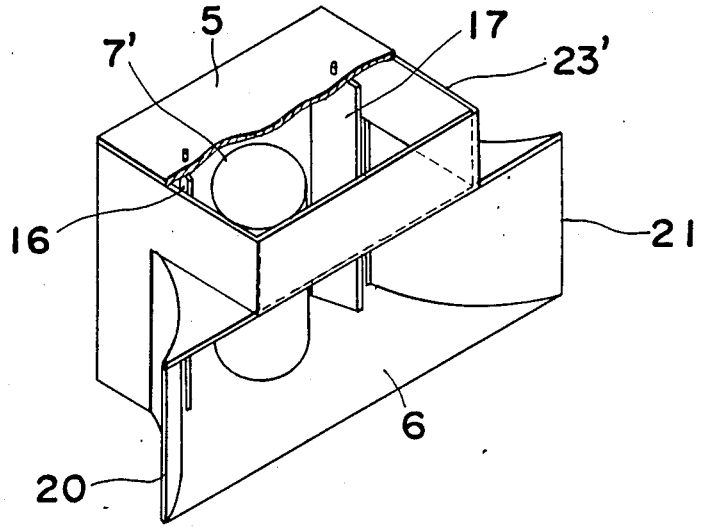
Figure 10:
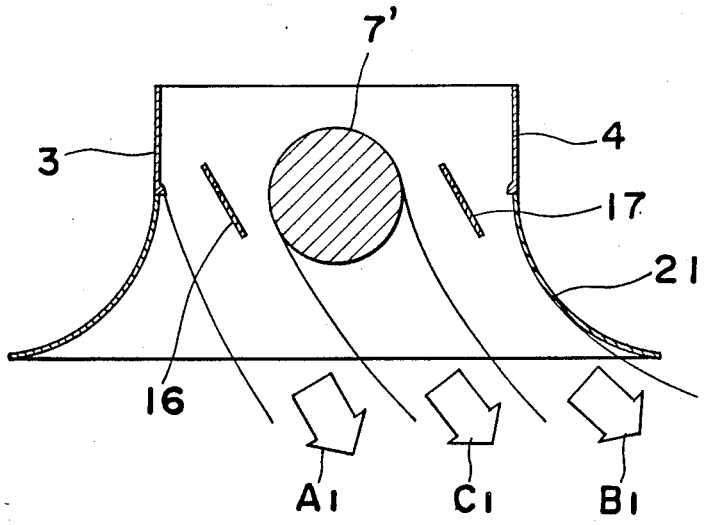
FIG. 10 is a top sectional view of the assembly shown in FIG. 9.

The flow control assembly shown in FIG. 9 is similar to that shown in and described with reference to FIG. 8 except that the partitioning member shown in FIG. 9 is comprised of a cylindrical column 7'. Although the flow control assembly according to the embodiment shown in FIG. 9 functions generally in a manner similar to that according to any one of the foregoing embodiments, a difference may be found when both of the deflector vanes 16 and 17 are pivoted to one of the first and second positions. By way of example, when both of the deflector vanes 16 and 17 are pivoted to the second position as shown in FIG. 10, the fluid streams B1 and C1 flow outwardly from the outlet 22 in a manner substantially similar to those shown in FIG. 5, but the fluid stream A1 is, as it flows outwardly from the outlet 22, drawn more rightwards than that shown in FIG. 5 because it tends to attach to the peripheral surface, that is, a curved surface region, of the cylindrical column 7'. This description can be equally applicable to the case wherein both of the deflector vanes 16 and 17 are pivoted to the first position for biasing the draft of fluid as a whole in a direction leftwards with respect to the flow deflecting assembly.

In any one of the foregoing embodiments of the present invention, the flow control assembly is so constructed as to provide not only first and second fluid streams passing through the respective nozzle openings, but also a third fluid stream directed so as to flow towards a region intermediate between the first and second fluid streams in a direction generally perpendicular to the direction of flow of any one of the first and second fluid streams. Accordingly, the flow control assembly according to any one of the foregoing embodiments has the following advantages.

(1) A wide angle deflection of fluid is possible while the draft of fluid emerging outwards from the assembly covers a relatively large width.

(2) A wide angle diffusion of the draft of fluid is also possible over the entire width of the outlet.

When the flow control assembly capable of exhibiting the above noted advantages is applied to a fan-forced space heater as an outlet grille structure, the draft of heated air can cover not only a relatively large area of the space to be heated, but also the substantially entire width of the space when swung from left to right and vice versa.

Moreover, in the present invention, since the third fluid stream may be a part of one or both of the first and second fluid streams, the flow deflecting assembly can be manufactured compact in size, and when the partitioning member is employed in the form of the cylindrical column, the wall attachment of the fluid stream which occurs at a downstream surface region of the cylindrical column with respect to the direction of flow of the fluid stream can be utilized to substantially converge the draft of fluid emerging outwardly from the outlet.

Hereinafter, application of the present invention to a fan-forced space heater of a type utilizing kerosene, electricity or gas will be described with particular reference to FIGS. 11 to 15 wherein like parts are designated by like reference numerals.

Figure 11:
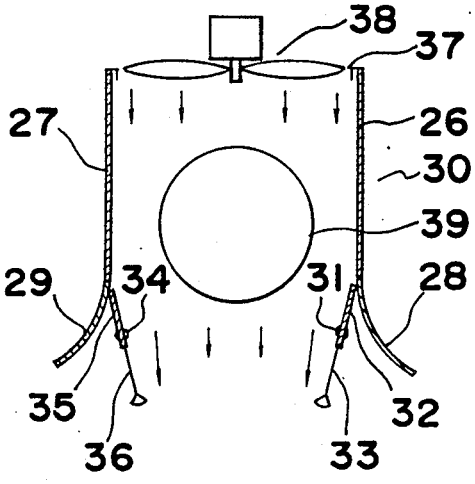
FIGS. 11 to 13 are schematic top sectional views of the fluid flow control assembly according to a fourth embodiment of the present invention with the deflector vanes held in different operative positions, respectively.
Figure 12:
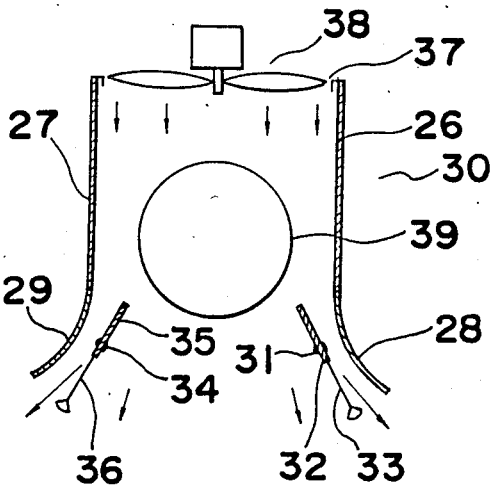
Figure 13:
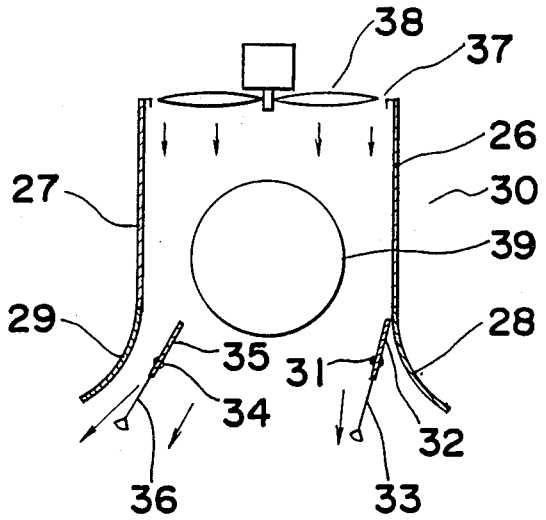

Referring to FIGS. 11 to 13 showing a first example of application of the present invention, reference numerals 26 and 27 represent right-hand and left-hand flat side walls, respectively, which altogether constitute an air duct 30. Reference numerals 28 and 29 represent right-hand and left hand guide walls, respectively, which extend outwardly from the walls 26 and 27 so as to diverge outwardly with respect to each other. A right-hand deflector vane 32 is supported for pivotal movement between first and second positions about a support shaft 31 located adjacent the guide wall 28 and generally on an extension of the right-hand flat side wall 26, and a left-hand deflector vane 35 is supported for pivotal movement between first and second positions about a support shaft 34 located adjacent the guide wall 29 and generally on an extension of the left-hand flat side wall 27. The position of each of the deflector vanes 32 and 35 can be manually adjusted by manipulating a respective knob 33 or 36 connected to the deflector vane 32 or 35 downstream thereof with respect to the direction of flow of heated air and accessible to the hand of an operative.

The duct 30 has an inlet opening 37 defined at one end thereof opposite to the guide walls 28 and 29, at which opening 37 is arranged a motor-driven fan 38 for creating a forced draft of air flowing through the duct 30 and emerging outwardly from an outlet grille defined by the guide walls 28 and 29. Positioned within the duct 30 intermediately between the side walls 26 and 27 and downstream of the motor-driven fan 38 is a heat generator which may be a gas burner, a kerosene burner or an electric heating element and which is operable to heat the forced draft of air in contact therewith.

The embodiment of the construction described with reference to FIGS. 11 to 13 functions substantially in the same manner as the flow control assembly shown in FIGS. 9 and 10. More specifically, the flow of air produced by the motor-driven fan 38 is divided by the heat generator 39 into right-hand and left-hand streams of air which are subsequently directed by the deflector vanes 32 and 35 so as to attach to the respective curved guide walls 28 and 29, while a stream of air flowing above the heat generator 39 is guided so as to flow downwards in front of the heat generator. Accordingly, the draft of heated air ready to emerge outwardly from the outlet grille can cover a relatively large width of space no matter what direction it has been deflected dependent on the positions of the deflector vanes 32 and 35. It is to be noted that no element for directing the air stream, which has passed above the heat generator 39, downwardly in front of and on the downstream side of the heat generator 39, which element corresponds to the covering 23' shown in any one of FIGS. 8 and 10, is illustrated therein.

The embodiment hereunder discussed is featured in that not only has design been made to the positions and shapes of the deflector vanes 32 and 35 so that the wall attachment of the air streams can be controlled for enabling the fan-forced space heater to produce a centered draft of heated air as well as a generally acutely biased draft of heated air, but also the curved guide walls 28 and 29 are formed substantially by bending respective end portions of the flat side walls 26 and 27 so as to diverge outwardly with respect to each other.

FIG. 11 illustrates a condition in which the deflector vanes 32 and 35 are held in the second and first positions, respectively, for directing the air streams to converge with each other to produce an intensified draft of heated air centered on a limited region of the space to be heated. So far as the deflector vanes 32 and 25 are held in the second and first positions, respectively, an upstream edge of each of the deflector vanes 32 and 35 are held in contact with a downstream end of the adjacent flat side wall 26 or 27 so that the respective deflector vane 32 or 35 acts as if it were an extension of the associated side wall 26 or 27. In other words, with the deflector vanes 32 and 35 held in the second and first positions, respectively, the duct 30 represents such a structure as if it would have an outwardly conveying end remote from the motor-driven fan 38, and accordingly, the intensified draft of heated air blowing frontwardly of the duct 30 and centered on a limited region of the space to be heated can be obtained.

FIG. 12 illustrates a condition in which the deflector vanes 32 and 35 are moved to the first and second positions, respectively, so as to diverge outwardly with respect to each other. In this condition, the air streams passing on respective sides of the heat generator 39 can be deflected by the deflector vanes 32 and 35 so as to flow along the guide walls 28 and 29, accompanied by the wall attachment phenomenon between the air streams and the adjacent guide walls 28 and 29, respectively. Accordingly, the draft of heated air emerging outwardly from the outlet grille can spread laterally outwardly covering a large width of the space to be heated. It is to be noted that, in this case, the deflection of the air stream is not forcibly achieved by the associated deflector vane, but by the wall attachment effect and, therefore, takes place with a minimized loss of pressure.

FIG. 13 illustrates a condition in which both of the deflector vanes 32 and 35 are moved to the first position so that the draft of heated air can emerge outwardly from the outlet grille, having been biased in a direction laterally outwardly, i.e., leftwards as viewed therein. This condition can be considered a combination of the right-hand half of FIG. 11 and the left-hand half of FIG. 12. In particular, in the condition of FIG. 13, the right-hand deflector vane 32 in the first position disables the right-hand guide wall 28 while aiding the leftward deflection of the air stream impinging upon such deflector vane 32.

Figure 14:
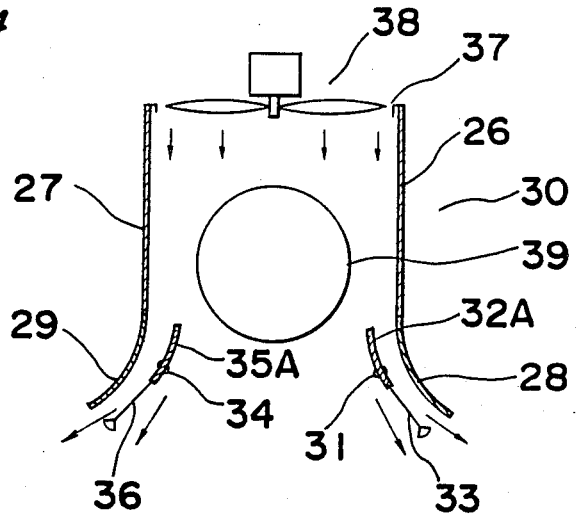
FIG. 14 and FIG. 15 are views similar to FIGS. 11 to 13, showing fifth and sixth embodiments of the present invention, respectively.

In the example shown in and described with reference to FIGS. 11 to 13 each of the deflector vanes 32 and 35 is in the form of a flat rectangular plate. However, it may be curved to generally follow the curvature of the adjacent guide wall 28 or 29 such as shown by 32A or 35A in FIG. 14. While in the foregoing example the wall attachment phenomenon occurs only between the right-hand air stream and the right-hand guide wall 28 and between the left-hand air stream and the left-hand guide wall 29, the example shown in FIG. 14 is such that the wall attachment takes place not only at a convex surface of each of the guide walls 28 and 29, but also at a convex surface of each of the curved deflector vanes 32A and 35A. Accordingly, as compared with the example shown in and described with reference to FIGS. 11 to 13, the example shown in and described with reference to FIG. 14 is effective to accomplish a relatively large wide angle deflection at a minimized loss of pressure. It is to be noted that the example of FIG. 14 can also be operable in a manner similar to that shown in any one of FIGS. 11 and 13.

Figure 15:
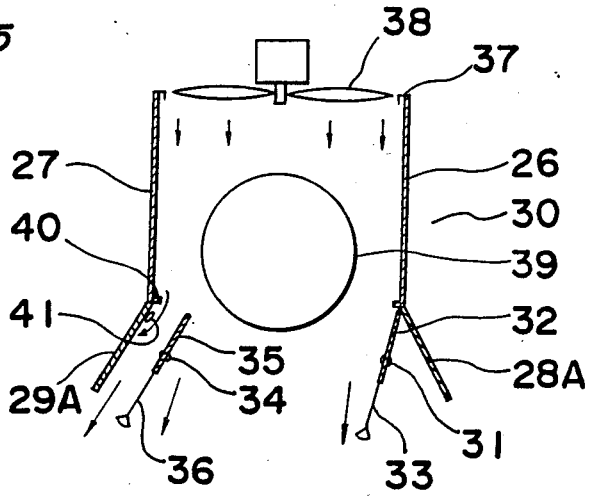

A further example shown in FIG. 15 has been designed to reduce the manufacturing cost. For this purpose, the outwardly diverging guide walls which have been shown and described as curved in the foregoing description are formed by flat walls as shown by 28A and 29A, respectively. As compared with the case with the curved guide walls, the wall attachment effect exhibited by the flat wuide walls 28A and 29A is relatively small and, therefore, a projection 40 for each joint between the side wall 26 or 27 and the adjacent guide wall 28A or 29A is formed so as to protrude a predetermined distance towards the heat generator 39 so that an air pocket or negative pressure zone 41 can be created on one side of the respective projection 40 adjacent the guide wall 28A or 29A as the air stream flows past such projection 40. The presence of the air pockets 41 is effective to enhance the wall attachment effect.

Any one of the foregoing examples featured in that it comprises an air duct having at least one pair of opposed flat side walls, a pair of guide walls connected to respective downstream ends of the flat walls and extending outwardly therefrom so as to diverge away from each other and a pair of deflector vanes each positioned adjacent the downstream end of the side wall and on the imaginary line generally lying on an extension of the associated flat side wall, is effective to exhibit the following advantages.

(1) When the deflector vanes are pivoted so as to outwardly converge with respect to each other, the air duct as a whole represents a shape having its downstream end tapered outwardly, and therefore, the draft of heated air to be centered on a limited region of the space can be obtained.

(2) When the deflector vanes are pivoted so as to outwardly diverge with respect to each other, the wall attachment of the air streams takes place at the respective guide walls, and therefore, the draft of heated air flowing laterally at a minimized loss of pressure can be obtained.

(3) When the deflector vanes are pivoted so as to assume a parallel relationship with the associated flat side walls, the draft of heated air flowing straight outwardly can be obtained.

(4) When only one of the deflector vanes is pivoted so as to deflect only one of the air streams which is directed towards such one of the deflector vanes, the draft of heated air biased in one direction can be obtained at a minimized loss of pressure while having intensified because such one of the deflector vanes forms a part of the wall.

As hereinbefore described, any one of the foregoing examples employs a fundamental structure wherein the paired, outwardly diverging guide walls are combined with the deflector vanes, which vanes are employed for forming respective parts of the wall of the air duct at a time and, at a different time, as control elements giving chances to bring about the wall attachment of the fluid medium to the guide walls, wherefore the center-orientated draft, the bilaterally-spread draft, or the unidirectionally biased draft, of air induced by the fan and subsequently heated by the heat generator can be obtained depending on the position of one or both of the deflector vanes. With the application of any one of the foregoing examples, a fan-forced space heater effective to produce the heated air comfortable to feel can be realized.

As hereinafter described, the present invention is effective to provide a fluid outlet grille structure for the fan-forced space heater, regardless of the kind of fuel used thereby, or an air-conditioner, which grille structure is capable of producing any one of the center-orientated, spread, and unidirectionally biased drafts of heated air depending on the position of one or both of the deflector vanes. This is accomplished because, according to the present invention, the design has been made to enable the fluid stream to be introduced in between the generally parallel fluid streams in a direction generally at right angles thereto.

Although the present invention has been fully described in connection with the preferred forms of embodiment thereof with reference to the accompanying drawings, it is to be noted that various changes and modifications are apparent to those skilled in the art. Such changes and modifications are to be understood as included within the scope of the present invention as defined by the appended claims, unless they depart therefrom.

We claim:

1. A fluid flow control assembly which comprises:

a fluid inlet structure having a fluid inlet region defined therein for the passage of fluid therethrough in one direction;

a fluid outlet defining structure fluid-connected with and positioned downstream of the inlet defining structure, said outlet defining structure including first and second guide walls extending outwardly from each other in a direction away from the inlet defining structure;

a partitioning member arranged in the inlet region for dividing the fluid flowing in the inlet region into first and second fluid streams as it passes through the inlet defining structure;

first and second deflector members disposed in respective paths of flow of the first and second fluid streams, each of said first and second deflector members being supported for angular movement about a respective axis between first and second positions for controlling the direction of flow of the respective fluid stream; and a passage means for introducing a third fluid stream in between the first and second fluid streams generally at right angles to the direction of flow of any one of the first and second fluid streams;

said first and second deflector members being so positioned as to control a wall attachment of the first and second fluid streams relative to the first and second guide walls wherefore a draft of fluid emerging outwardly from the outlet defining structure can be directed outwardly, be biased in one lateral direction or be centered on a limited region.

2. The assembly as claimed in claim 1, wherein the partitioning member comprises a cylindrical column.

3. The assembly as claimed in claim 1, wherein the partitioning member comprises a cylindrical burner.

4. The assembly as claimed in claim 2, wherein the passage means originates from the partitioning member, and the third fluid stream bypasses the partitioning member.

5. The assembly as claimed in claim 3, wherein the passage means originates from the partitioning member, and the third fluid stream bypasses the partitioning member.

6. The assembly as claimed in claim 1, wherein when the first and second deflector members are angularly moved to the second and first positions, respectively, an upstream side of each of the first and second deflector members with respect to the direction of flow of the fluid streams is held in contact with the adjacent guide wall.

7. The assembly as claimed in claim 2, wherein when the first and second deflector members are angularly moved to the second and first positions, respectively, an upstream side of each of the first and second deflector members with respect to the direction of flow of the fluid streams is held in contact with adjacent guide wall.

8. The assembly as claimed in claim 3, wherein when the first and second deflector members are angularly moved to the second and first positions, respectively, an upstream side of each of the first and second deflector members with respect to the direction of flow of the fluid streams is held in contact with the adjacent guide wall.

9. The assembly as claimed in claim 6, wherein the first and second guide walls are curved in a direction away from each other, and wherein each of the first and second deflector members is correspondingly curved to follow the curvature of the adjacent guide wall.

10. The assembly as claimed in claim 7, wherein the first and second guide walls are curved in a direction away from each other, and wherein each of the first and second deflector members is correspondingly curved to follow the curvature of the adjacent guide wall.

11. The assembly as claimed in claim 8, wherein the first and second guide walls are curved in a direction away from each other, and wherein each of the first and second deflector members is correspondingly curved to follow the curvature of the adjacent guide wall.

12. The assembly as claimed in claim 6, wherein the first and second guide walls are flat.

13. The assembly as claimed in claim 7, wherein the first and second guide walls are flat.

14. The assembly as claimed in claim 8, wherein the first and second guide walls are flat.

* * * * *